US009243572B2

(12) United States Patent
Nakajima et al.

(10) Patent No.: US 9,243,572 B2
(45) Date of Patent: Jan. 26, 2016

(54) INTERNAL COMBUSTION ENGINE AND STRADDLE-TYPE VEHICLE EQUIPPED WITH THE ENGINE

(75) Inventors: Akitoshi Nakajima, Shizuoka (JP); Toshinori Inomori, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 647 days.

(21) Appl. No.: 13/552,671

(22) Filed: Jul. 19, 2012

(65) Prior Publication Data

US 2013/0024099 A1 Jan. 24, 2013

(30) Foreign Application Priority Data

Jul. 20, 2011 (JP) ..... 2011-158620

(51) Int. Cl.
*F02P 5/14* (2006.01)
*F02D 35/02* (2006.01)

(52) U.S. Cl.
CPC ..... *F02D 35/027* (2013.01)

(58) Field of Classification Search
CPC ..... F02P 5/14; F02B 77/00; G01L 23/22; F02D 35/027
USPC ..... 123/195 C, 90.31, 406.29; 73/35.01; 29/888.01; 701/111
See application file for complete search history.

(56) References Cited

U.S. PATENT DOCUMENTS 5,228,294 A 7/1993 Murray
6,568,376 B2 5/2003 Sonnleitner et al.
7,055,495 B2 6/2006 Yamaoka et al.
7,182,073 B1 2/2007 Kim
7,669,559 B2 3/2010 Aoyama et al.
2004/0182360 A1 9/2004 Mashiki
2005/0022582 A1* 2/2005 Barron et al. ..... 73/35.01
2006/0081034 A1 4/2006 Kohashi et al.
2006/0086177 A1 4/2006 Okubo et al.
2007/0044774 A1 3/2007 Kim
2007/0157912 A1* 7/2007 Ritter et al. ..... 123/679
2008/0028603 A1* 2/2008 Takegawa et al. ..... 29/888.01
2008/0295577 A1 12/2008 Maehara et al.
2009/0204313 A1 8/2009 Catanese (Continued)

FOREIGN PATENT DOCUMENTS

CN 1924325 A 3/2007
CN 101315310 A 12/2008
CN 100520031 C 7/2009

(Continued)

OTHER PUBLICATIONS

Nakajima et al.; "Internal Combustion Engine and Straddle-Type Vehicle Equipped With the Engine"; U.S. Appl. No. 13/552,669, filed Jul. 19, 2012.

(Continued)

*Primary Examiner* — Stephen K Cronin
*Assistant Examiner* — Xiao Mo
(74) *Attorney, Agent, or Firm* — Keating and Bennett, LLP

(57) ABSTRACT

A single-cylinder internal combustion engine includes a knock sensor mounted to apart other than a cylinder block to detect knocking. The engine includes a crankcase, a cylinder block, and a cylinder head connected by a bolt. A boss to mount the knock sensor is provided on the crankcase. A center of the boss is positioned on a same side of a cylinder axis as the bolt, when viewed in an axial direction of the boss.

16 Claims, 6 Drawing Sheets

(56) References Cited

U.S. PATENT DOCUMENTS

| | | | | |
|---|---|---|---|---|
| 2010/0162795 | A1 | 7/2010 | Kaneko et al. | |
| 2010/0242885 | A1 * | 9/2010 | Tabinoki et al. | 123/90.31 |

FOREIGN PATENT DOCUMENTS

| | | | | | |
|---|---|---|---|---|---|
| CN | 1760654 | B | | 7/2011 | |
| EP | 1 460 265 | B1 | | 7/2006 | |
| JP | 2003-343311 | A | | 12/2003 | |
| JP | 2003343311 | A | * | 12/2003 | F02D 35/00 |
| JP | 2004-301106 | A | | 10/2004 | |
| TW | 212824 | | | 9/1993 | |
| TW | 200728599 | A | | 8/2007 | |
| TW | 200925401 | A | | 6/2009 | |
| TW | I314179 | B | | 9/2009 | |

OTHER PUBLICATIONS

Nakajima et al.; "Internal Combustion Engine and Straddle-Type Vehicle Equipped With the Engine"; U.S. Appl. No. 13/552,670, filed Jul. 19, 2012.

Nakajima et al.; "Internal Combustion Engine and Straddle-Type Vehicle Equipped With the Engine"; U.S. Appl. No. 13/552,672, filed Jul. 19, 2012.

Official Communication issued in corresponding Chinese Patent Application No. 201210259910.2, mailed on May 5, 2014.

Official Communication issued in corresponding Taiwanese Patent Application No. 101126092, mailed on Jan. 20, 2014.

* cited by examiner

INTERNAL COMBUSTION ENGINE AND STRADDLE-TYPE VEHICLE EQUIPPED WITH THE ENGINE

BACKGROUND OF THE INVENTION

1. Field of the Invention

The present invention relates to an internal combustion engine fitted with a sensor arranged to detect knocking. The present invention also relates to a straddle-type vehicle equipped with the engine.

2. Description of the Related Art

An internal combustion engine can cause knocking in some cases depending on its operating conditions. Knocking should be avoided as much as possible because it results in, for example, unusual noise and performance degradation of the internal combustion engine. Conventionally, it is known that a sensor to detect knocking, that is, a knock sensor, is fitted to an internal combustion engine. It is also known that, upon detecting knocking by the knock sensor, an action such as changing ignition timing is taken.

JP 2004-301106 A discloses a water-cooled engine in which a knock sensor is fitted to a cylinder block.

Knocking occurs in a combustion chamber. When knocking takes place, the vibration resulting from the knocking propagates from the combustion chamber to the cylinder block, and then to the crankcase. Since the cylinder block is closer to the combustion chamber than to the crankcase, knocking can be detected more accurately when the knock sensor is provided on the cylinder block than when the knock sensor is provided on the crankcase. The cylinder head is provided with an intake valve, an exhaust valve, and a cam mechanism to open and close the intake valve and the exhaust valve. Although the cylinder head is close to the combustion chamber, the cylinder head is more affected by the vibrations that do not result from the knocking than the cylinder block. For this reason, the knock sensor is less affected by the vibrations that do not result from the knocking when it is provided on the cylinder block than when it is provided on the cylinder head.

Nevertheless, in some cases, the knock sensor cannot be disposed on the cylinder block due to, for example, the layout constraints of the internal combustion engine or the heat resistance performance of the knock sensor.

SUMMARY OF THE INVENTION

In view of the problems described above, preferred embodiments of the present invention enable a single-cylinder internal combustion engine in which a knock sensor is mounted to a part other than the cylinder block to appropriately detect knocking.

An internal combustion engine according to a preferred embodiment of the present invention is preferably a single-cylinder internal combustion engine for a vehicle including: a crankcase including one or more holes; a cylinder block including one or more through-holes and including a cylinder provided therein; a cylinder head including one or more through-holes and being mounted on top of the cylinder block; a bolt inserted through the one or more holes of the crankcase, the one or more through-holes of the cylinder block, and the one or more through-holes of the cylinder head, to fix the crankcase, the cylinder block, and the cylinder head to each other; a sensor mounting boss provided on the crankcase or the cylinder head; and a sensor arranged to detect knocking, wherein the sensor is mounted to the boss, and, when viewed in an axial direction of the boss, the center of the boss is positioned on a same side of a cylinder axis as the bolt.

Various preferred embodiments of the present invention make it possible to appropriately detect knocking in a single-cylinder internal combustion engine in which a knock sensor is mounted to a part other than the cylinder block.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
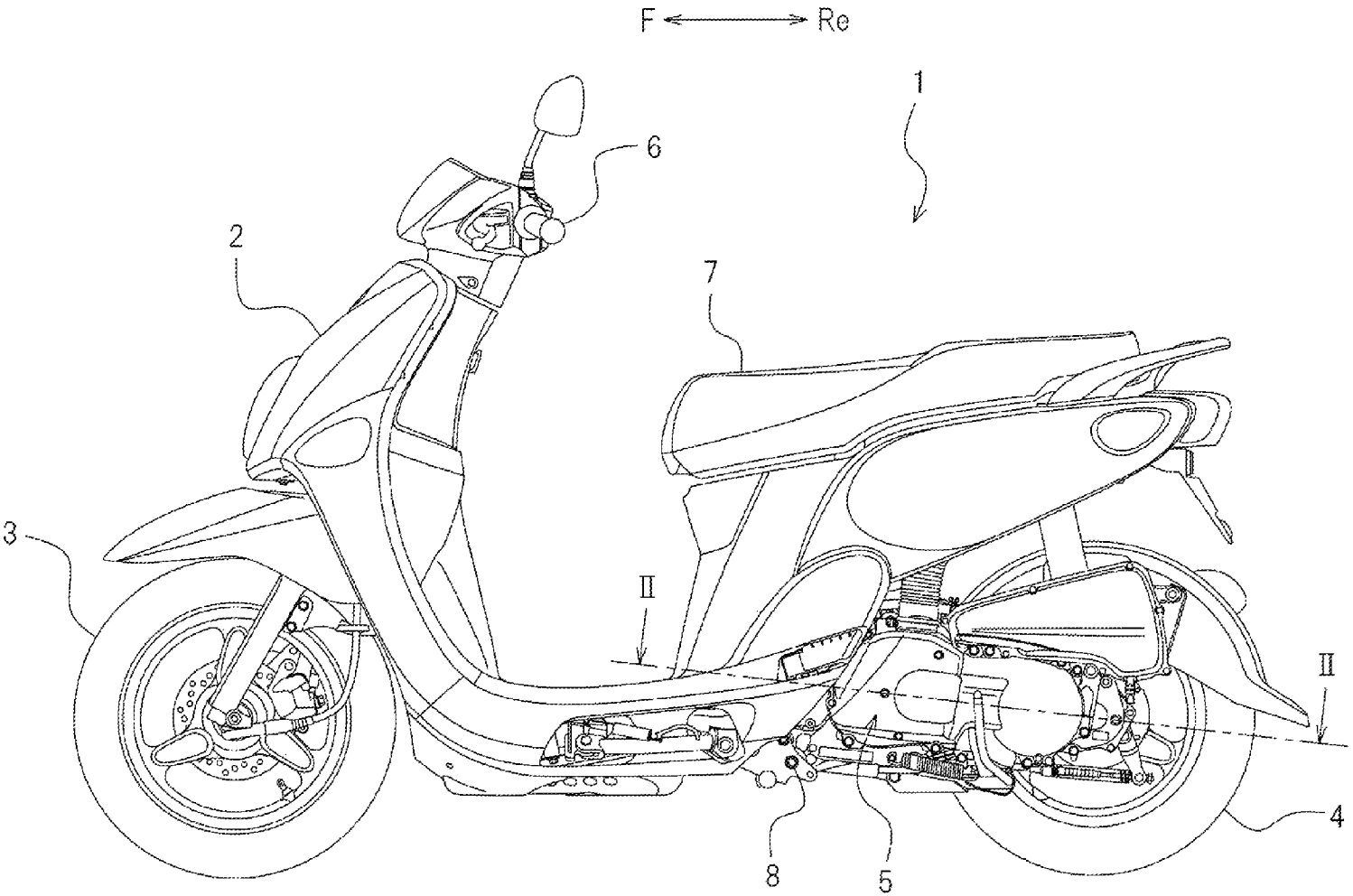
FIG. 1 is a left side view of a motorcycle according to a first preferred embodiment of the present invention.

As illustrated in FIG. 1, the straddle-type vehicle according to the first preferred embodiment is preferably a scooter type motorcycle 1, for example. Although the motorcycle 1 is one example of a straddle-type vehicle according to a preferred embodiment of the present invention, the straddle-type vehicle is not limited to the scooter type motorcycle 1. The straddle-type vehicle may be any other type of motorcycle, such as a moped type motorcycle, an off-road type motorcycle, or an on-road type motorcycle, for example. In addition, the straddle-type vehicle is intended to mean any type of vehicle on which a rider straddles the vehicle, and it is not limited to a two-wheeled vehicle. The straddle-type vehicle may be, for example, a three-wheeled vehicle that changes its traveling direction by leaning the vehicle body. The straddle-type vehicle may be other types of straddle-type vehicle such as an ATV (All Terrain Vehicle), for example.

In the following description, the terms "front," "rear," "left," and "right" respectively refer to front, rear, left, and right based on the perspective of the rider of the motorcycle 1. Reference characters F, Re, L, and R in the drawings indicate front, rear, left, and right, respectively.

The motorcycle 1 includes a vehicle body 2, a front wheel 3, a rear wheel 4, and an engine unit 5 to drive the rear wheel 4. The vehicle body 2 includes a handlebar 6, which is operated by the rider, and a seat 7, on which the rider is to be seated. The engine unit 5 is what is called a unit swing type engine unit, and it is supported by a body frame, not shown in the drawings, so that it can pivot about a pivot shaft 8. The engine unit is supported so as to be swingable relative to the body frame.

Figure 2:
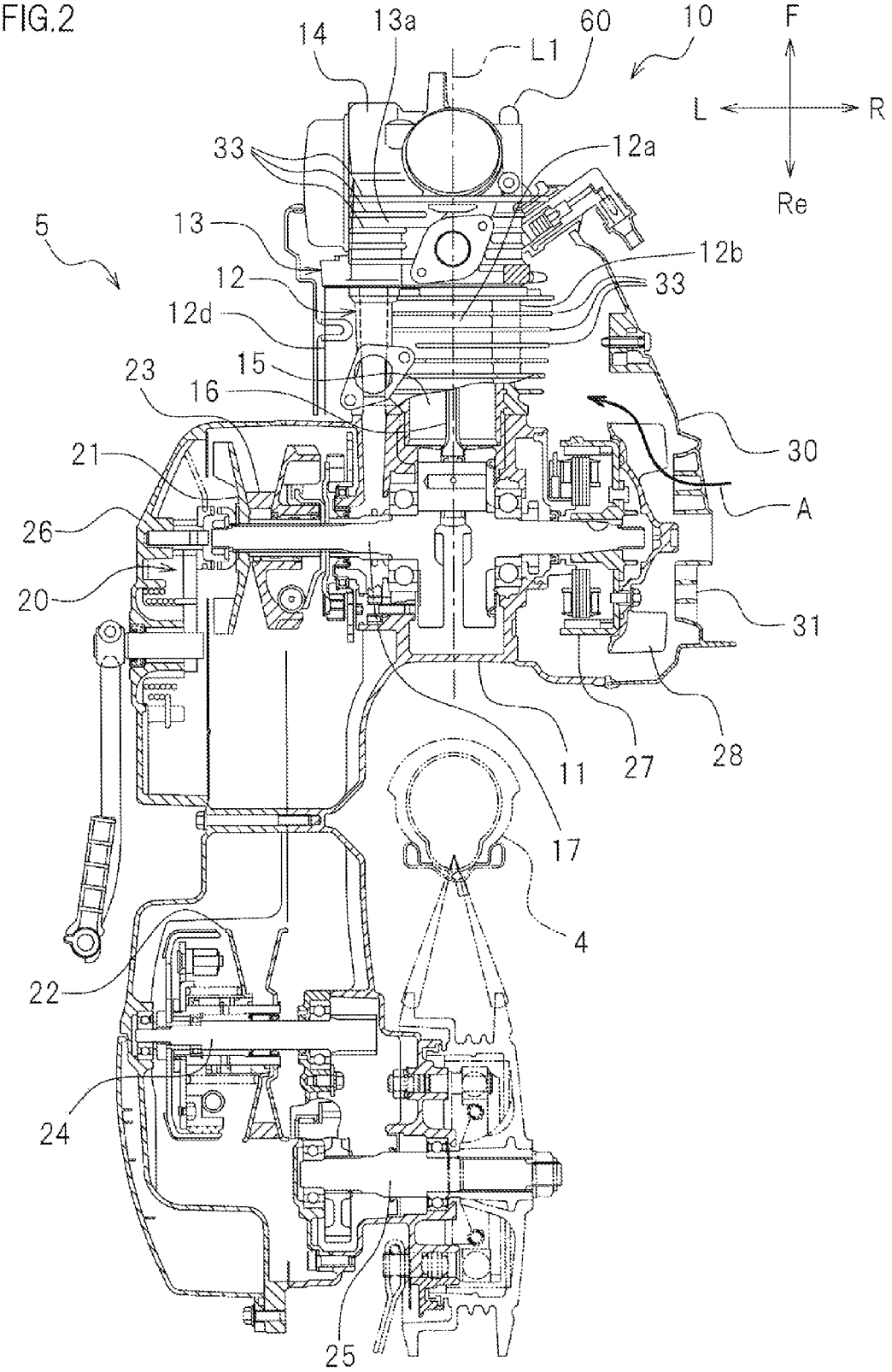
FIG. 2 is a cross-sectional view taken along line II-II of FIG. 1.

FIG. 2 is a cross-sectional view taken along line II-II of FIG. 1. As illustrated in FIG. 2, the engine unit 5 includes an engine 10, which is one example of the internal combustion engine according to a preferred embodiment of the present invention, and a V-belt type continuously variable transmission (hereinafter referred to as "CVT") 20. The CVT 20 is one example of a transmission. In the present preferred embodiment, the engine 10 and the CVT 20 integrally form the engine unit 5, but it is of course possible that the engine 10 and a transmission may be separated from each other.

The engine 10 is preferably an engine that includes a single cylinder, in other words, a single-cylinder engine, for example. The engine 10 is preferably a four-stroke engine, which repeats an intake stroke, a compression stroke, a combustion stroke, and an exhaust stroke, one after another, for example. The engine 10 includes a crankcase 11, a cylinder block 12 extending frontward from the crankcase 11, a cylinder head 13 connected to a front portion of the cylinder block 12, and a cylinder head cover 14 connected to a front portion of the cylinder head 13. A cylinder 15 is provided inside the cylinder block 12.

The cylinder 15 may be defined by a cylinder liner inserted in the body of the cylinder block 12 (i.e., in the portion of the cylinder block 12 other than the cylinder 15) or may be integrated with the body of the cylinder block 12. In other words, the cylinder 15 may be provided either separate from or integral with the body of the cylinder block 12. A piston, not shown in the drawings, is slidably accommodated in the cylinder block 15.

The cylinder head 13 covers a front portion of the cylinder 15. A recessed portion, not shown in the drawings, and an intake port and an exhaust port, also not shown in the drawings, that are connected to the recessed portion are provided in the cylinder head 13. An intake pipe 35 (see FIG. 3) is connected to the intake port, and an exhaust pipe 38 is connected to the exhaust port. The top surface of the piston, the inner circumferential surface of the cylinder 15, and the recessed portion together define a combustion chamber, which is not shown in the drawings. The piston is coupled to a crankshaft 17 via a connecting rod 16. The crankshaft 17 extends leftward and rightward. The crankshaft 17 is accommodated in the crankcase 11.

Figure 3:
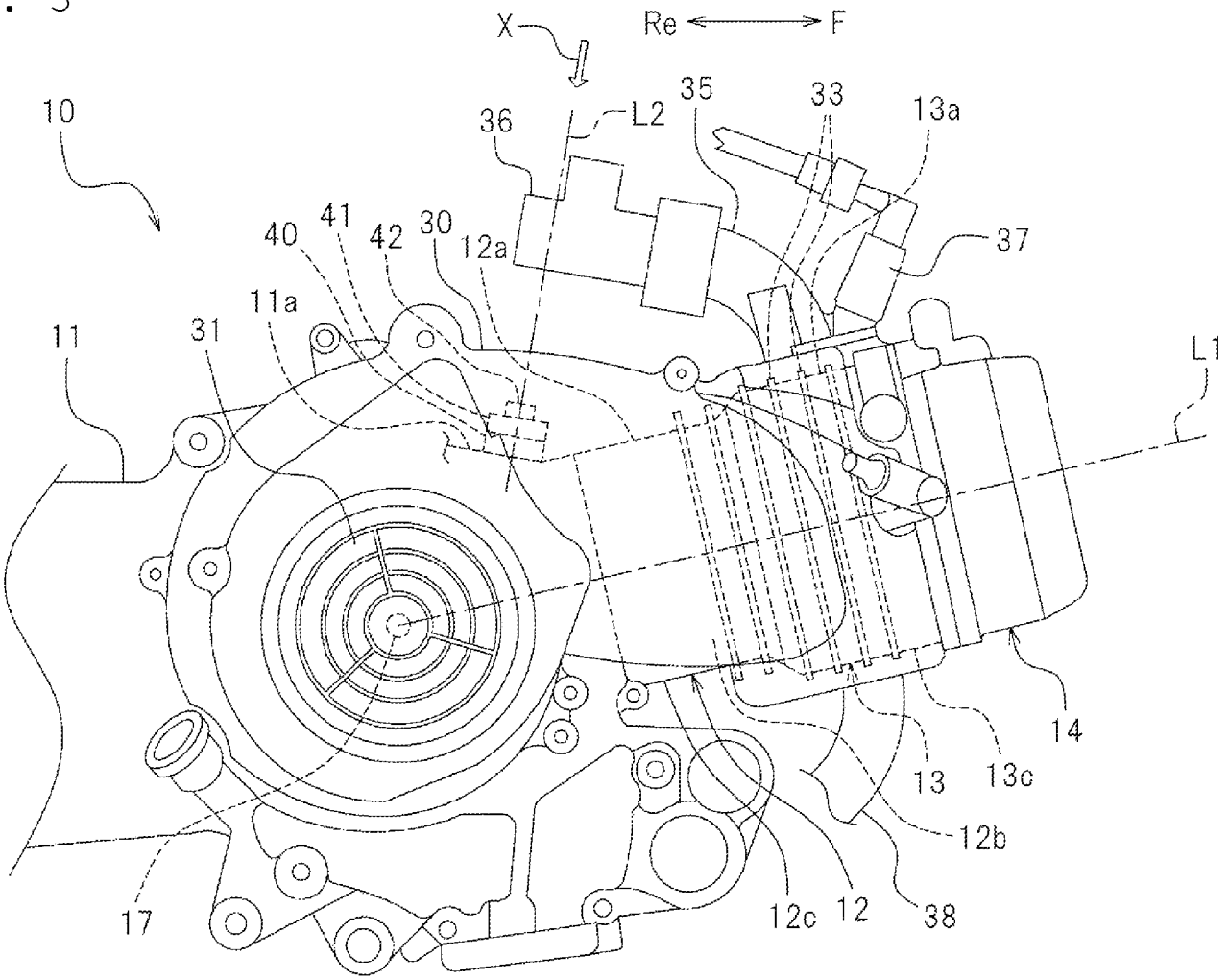
FIG. 3 is a right side view illustrating a portion of an engine according to the first preferred embodiment of the present invention.

As illustrated in FIG. 3, the engine 10 according to the present preferred embodiment is a type of engine in which the cylinder block 12 and the cylinder head 13 extend in a horizontal direction or in a direction inclined slightly upward with respect to a horizontal direction toward the front, that is, what is called a horizontally mounted type engine. Reference character L1 represents the line that passes through the center of the cylinder 15 (see FIG. 2, the line is hereinafter referred to as the "cylinder axis"). The cylinder axis L1 extends in a horizontal direction or in a direction slightly inclined from a horizontal direction. It should be noted, however, that the direction of the cylinder axis L1 is not particularly limited. For example, the inclination angle of the cylinder axis L1 with respect to the horizontal plane may be from 0° to 15°, for example, or may be greater.

In the present preferred embodiment, the crankcase 11, the cylinder block 12, the cylinder head 13, and the cylinder head cover 14 are separate parts, and they are fitted to each other. As illustrated in FIG. 2, the crankcase 11, the cylinder block 12, the cylinder head 13, and the cylinder head cover 14 are connected to each other by at least one cylinder holding bolt (hereinafter, simply referred to as a "bolt") 60.

Figure 4:
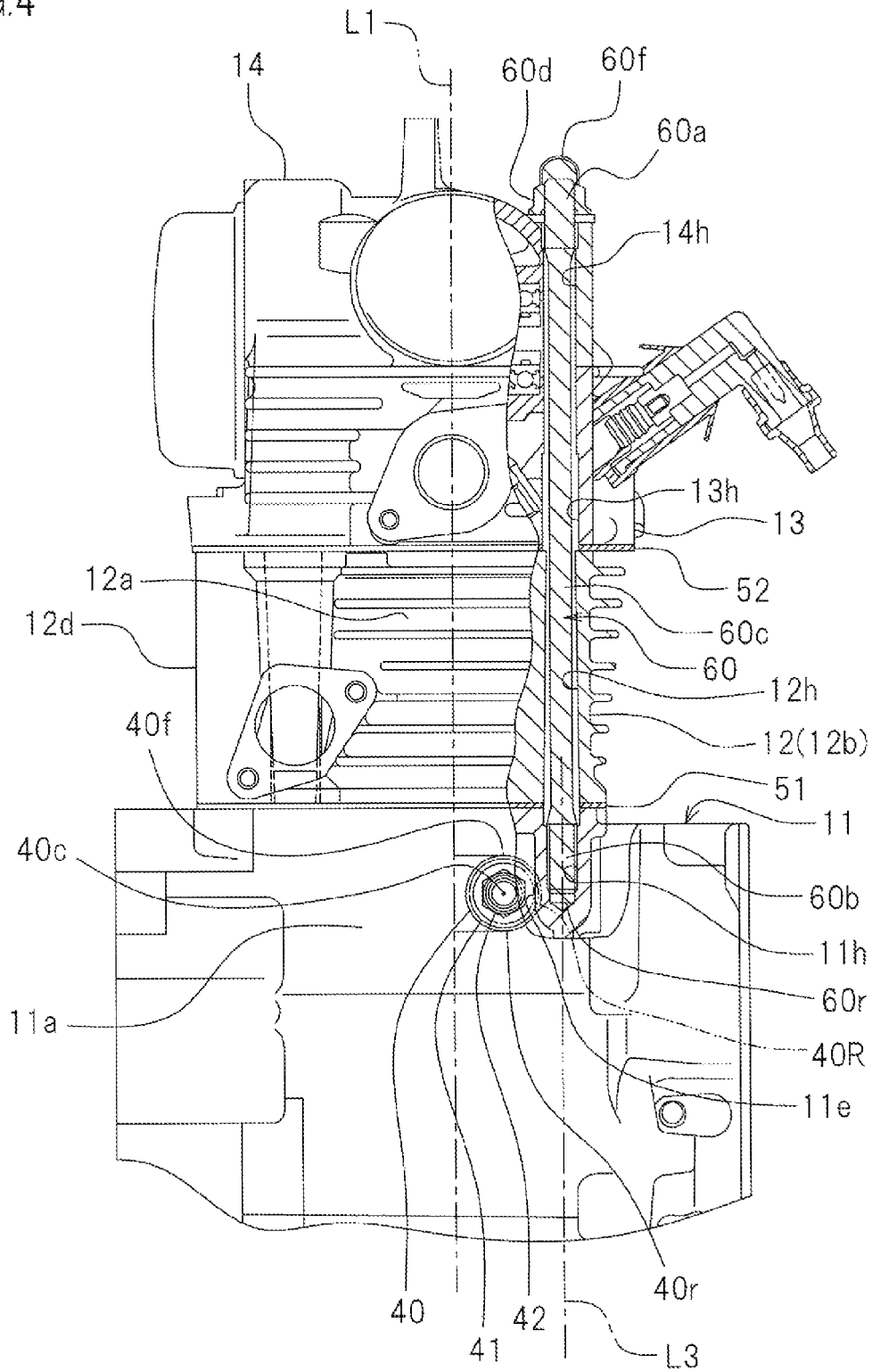
FIG. 4 is a view illustrating a portion of the engine, shown partly in section, viewed from an axial direction of the boss.

More specifically, as illustrated in FIG. 4, a hole 11*h* is provided in the crankcase 11, a through-hole 12*h* is provided in the cylinder block 12, a through-hole 13*h* is provided in the cylinder head 13, and a through-hole 14*h* is provided in the cylinder head cover 14. The hole 11*h*, the through-hole 12*h*, the through-hole 13*h*, and the through-hole 14*h* extend parallel or substantially parallel to the cylinder axis L1, and the centers thereof are in alignment with each other. The bolt 60 is inserted through the hole 11*h*, the through-hole 12*h*, the through-hole 13*h*, and the through-hole 14*h*. Note that the hole 11*h* of the crankcase 11 may be either a hole having a closed bottom as in the present preferred embodiment or a through-hole without a closed bottom.

The shape of the bolt 60 is not particularly limited. Each of an upper portion 60*a* and a lower portion 60*b* of the bolt 60 includes a helical groove provided in the outer circumferential surface thereof, and the upper portion 60*a* and the lower portion 60*b* constitute external thread portions. An intermediate portion 60*c* of the bolt 60 preferably has no helical groove in the outer circumferential surface thereof. A helical groove that engages with the helical groove of the upper portion 60*a* of the bolt 60 is provided in the inner circumferential surface of the through-hole 14*h* of the cylinder head cover 14. A helical groove that engages with the helical groove of the lower portion 60*b* of the bolt 60 is provided in the inner circumferential surface of the hole 11*h* of the crankcase 11. The through-hole 14*h* and the hole 11*h* constitute internal thread portions. The bolt 60 is inserted through the hole 11*h*, the through-hole 12*h*, the through-hole 13*h*, and the through-hole 14*h* and is rotated therein, so that the lower portion 60*b* and the upper portion 60*a* can engage with the hole 11*h* and the through-hole 14*h*, respectively. Thus, the crankcase 11, the cylinder block 12, the cylinder head 13, and the cylinder head cover 14 are connected by the bolt 60.

However, as already mentioned above, the shape of the bolt 60 is not in any way limited. For example, it is possible that the intermediate portion 60*c* of the bolt 60 may have a helical groove provided in the outer circumferential surface thereof. It is also possible that one or both of the inner circumferential surfaces of the through-hole 12*h* of the cylinder block 12 and the through-hole 13*h* of the cylinder head 13 may have a helical groove that engages with the helical groove of the intermediate portion 60*c* of the bolt 60. The bolt 60 does not necessarily have a head portion 60*d* that is integrally provided therewith. It is possible that a nut, which is a separate part, may be fitted into the upper portion 60*a* of the bolt 60, in place of the head portion 60*d*.

As will be described below, the bolt 60 also serves the role of transmitting vibrations. It is preferable that the bolt 60 has a solid body so that it can transmit vibrations easily. However, the bolt 60 may have a hollow body as long as it can sufficiently transmit vibrations. In addition, it is preferable that the bolt 60 be integral so that it can transmit vibrations easily. However, the bolt 60 may be provided by a plurality of members combined with each other as long as it can sufficiently transmit vibrations. The outer circumferential surface of the bolt 60 and the inner circumferential surface of the through-hole 12*h* of the cylinder block 12 may or may not be in direct contact with each other. The outer circumferential surface of the bolt 60 and the inner circumferential surface of the through-hole 13*h* of the cylinder head 13 may or may not be in direct contact with each other.

The crankcase 11, the cylinder block 12, the cylinder head 13, and the cylinder head cover 14 are made of a metallic material. Suitable examples of the metallic material include cast iron and aluminum. Gaskets 51 and 52, each having a lower thermal conductivity than the metallic material, are provided between the crankcase 11 and the cylinder block 12 and between the cylinder block 12 and the cylinder head 13, respectively. The gaskets 51 and 52 are preferably made of a metallic material coated with a resin, for example. When the gaskets 51 and 52 are made of a combination of a plurality of materials in this way, the thermal conductivity of the gaskets 51 and 52 is intended to mean the thermal conductivity of the material that is disposed on their surfaces. The structure and material of the gaskets 51 and 52 are not particularly limited, and the gaskets 51 and 52 may be made of a single material. For example, the gaskets 51 and 52 may be made of a resin material. The material of the gasket 51 and that of the gasket 52 may be either the same or different.

In the present preferred embodiment, the crankcase 11, the cylinder block 12, the cylinder head 13, and the cylinder head cover 14 preferably are separate parts. However, it is not necessary that all of them are separate parts, and it is possible that they may be integrally provided with one another as appropriate. For example, the crankcase 11 and the cylinder block 12 may be provided integrally with each other, or the cylinder block 12 and the cylinder head 13 may be provided integrally with each other. Alternatively, the cylinder head 13 and the cylinder head cover 14 may be provided integrally with each other.

The entirety of the cylinder block 12, the cylinder head 13, and the cylinder head cover 14 preferably has a substantially quadrangular prism shape. The cylinder block 12 includes a top surface 12*a*, a right surface 12*b*, a bottom surface 12*c* (see FIG. 3), and a left surface 12*d*. Likewise, each of the cylinder head 13 and the cylinder head cover 14 includes a top surface, a right surface, a bottom surface, and a left surface. The position and the number of bolts 60 are not particularly limited. However, in the present preferred embodiment, a bolt 60 is preferably disposed at each of the four corners of each of the cylinder block 12, the cylinder head 13, and the cylinder head cover 14. In other words, a bolt 60 is disposed at each of the top right portion, the bottom right portion, the top left portion, and the bottom left portion of each of the cylinder block 12 and so forth.

As illustrated in FIGS. 3 and 4, a sensor mounting boss 40 is preferably provided on the top surface 11*a* of the crankcase 11. The boss 40 is preferably integrally provided with the crankcase 11. The boss 40 preferably has a tubular shape having a large wall thickness, for example. A knock sensor 41 to detect knocking is disposed on the boss 40. When knocking occurs, the combustion pressure abruptly changes, so specific vibration occurs in, for example, the cylinder block 12 and the cylinder head 13. As the knock sensor 41, it may be preferable to use, for example, a sensor that detects vibration and converts the vibration into an electric signal to output the signal (for example, a sensor equipped with a piezoelectric element).

The shape of the knock sensor 41 is not particularly limited. In the present preferred embodiment, however, the knock sensor 41 preferably has a tubular shape having a flat top surface and a flat bottom surface, for example. The knock sensor 41 preferably has a cylindrical shape having substantially the same inner diameter and substantially the same outer diameter as those of the boss 40. However, the shape of the knock sensor 41 is not limited to the tubular shape and may be other shapes. The inner diameter of the knock sensor 41 may be different from the inner diameter of the boss 40, and the outer diameter of the knock sensor 41 may be different from the outer diameter of the boss 40. The knock sensor 41 is preferably mounted to the boss 40 by a bolt 42. The bolt 42 is inserted through the hole of the boss 40 and the hole of the knock sensor 41.

The knock sensor 41 can be fitted by placing the knock sensor 41 on the boss 40, inserting the bolt 42 through the knock sensor 41 and the boss 40, and thereafter tightening the bolt 42. A helical groove that engages with the bolt 42 may be provided in an inner circumferential surface of the boss 40. Thereby, when the bolt 42 is rotated, the bolt 42 and the boss 40 are directly engaged with each other. However, the method of securing the bolt 42 is not particularly limited. Another possible method is as follows. A bolt 42 (which does not have a head but has only a shaft portion) is embedded in the boss 40 in advance, then the knock sensor 41 and a nut are fitted to the bolt 42 successively, and then, the nut is tightened.

In FIG. 3, reference character L2 indicates the central line of the boss 40. The direction in which the central line L2 extends is the axial direction of the boss. The arrow X indicates the axial direction of the boss. FIG. 4 is a view showing a portion of the engine 10, viewed in the direction indicated by the arrow X. In other words, FIG. 4 is a view showing a portion of the engine 10, viewed in the axial direction of the boss 40.

As illustrated in FIG. 4, the center 40*c* of the boss 40 is shifted rightward from the cylinder axis L1, when viewed in an axial direction of the boss 40. The bolt 60 is positioned on the right side of the cylinder axis L1, when viewed in the axial direction of the boss 40. The center 40*c* of the boss 40 is positioned on a same side of the cylinder axis L1 as the bolt 60, when viewed in the axial direction of the boss 40.

When viewed in the axial direction of the boss 40, the center 40*c* of the boss 40 may be located either at a position more to the right than the bolt 60 or at a position that overlaps with the bolt 60, but in the present preferred embodiment, the center 40*c* of the boss 40 is positioned more to the left than the bolt 60. In other words, when viewed in the axial direction of the boss 40, the center 40*c* of the boss 40 is positioned between the cylinder axis L1 and the bolt 60.

A right side portion 40R of the boss 40 is provided at a location overlapping with a peripheral portion 11*e* of the hole 11*h* of the crankcase 11, when viewed in the axial direction of the boss 40. In other words, at least a portion of the boss 40 overlaps with the peripheral portion 11*e* of the hole 11*h* of the crankcase 11, when viewed in the axial direction of the boss 40.

The front end 40*f* of the boss 40 is positioned frontward of the rear end 60*r* of the bolt 60. The rear end 40*r* of the boss 40 is positioned rearward of the front end 60*f* of the bolt 60. In other words, the boss 40 and a portion of the bolt 60 are disposed so as to be aligned, one on the right and the other on the left.

The boss 40 extends in a direction orthogonal or substantially orthogonal to the top surface 11*a* of the crankcase 11. However, the direction in which the boss 40 protrudes is not particularly limited, and the boss 40 may protrude in a direction inclined with respect to the top surface 11*a* of the crankcase 11.

As illustrated in FIG. 3, the intake pipe 35 is connected to the top surface 13*a* of the cylinder head 13. A throttle body 36 that accommodates a throttle valve, which is not shown in the drawings, is connected to the intake pipe 35. When viewed from the side, the knock sensor 41 is disposed below the intake pipe 35 or the throttle body 36. A fuel injection valve 37 is disposed in front of the intake pipe 35. When viewed from the side, the knock sensor 41 is disposed on the opposite side of the intake pipe 35 (the left side of FIG. 3) to the side on which the fuel injection valve 37 is disposed (the right side of FIG. 3). The exhaust pipe 38 is connected to the bottom surface 13*c* of the cylinder head 13.

As illustrated in FIG. 2, the CVT 20 includes a first pulley 21, which is a driving pulley, a second pulley 22, which is a driven pulley, and a V-belt 23 wrapped around the first pulley 21 and the second pulley 22. A left end portion of the crankshaft 17 protrudes to the left from the crankcase 11. The first pulley 21 is fitted to the left end portion of the crankshaft 17.

The second pulley 22 is fitted to a main shaft 24. The main shaft 24 is coupled to a rear wheel shaft 25 via a gear mechanism, which is not shown in the drawings. FIG. 2 depicts the state in which the transmission ratio for a front portion of the first pulley 21 and the transmission ratio for a rear portion of the first pulley 21 are different from each other. The second pulley 22 preferably has the same configuration. A transmission case 26 is provided on the left side of the crankcase 11. The CVT 20 is accommodated in the transmission case 26.

An alternator 27 is provided on a right side portion of the crankshaft 17. A fan 28 is secured to a right end portion of the crankshaft 17. The fan 28 rotates with the crankshaft 17. The fan 28 is provided to suck air to the left by rotating. An air shroud 30 is disposed on the right side of the crankcase 11, the cylinder block 12, and the cylinder head 13. The alternator 27 and the fan 28 are accommodated in the air shroud 30. The air shroud 30 and the fan 28 are one example of an air guide member, and they serve the role of guiding air mainly to the crankcase 11, the cylinder block 12, and the cylinder head 13. A suction port 31 is provided in the air shroud 30. The suction port 31 is positioned on the right side of the fan 28. The suction port 31 is provided at a position facing the fan 28. As indicated by arrow A in FIG. 2, the air sucked by the fan 28 is introduced through the suction port 31 into the air shroud 30 and is supplied to, for example, the crankcase 11, the cylinder block 12, and the cylinder head 13.

As illustrated in FIG. 3, the air shroud 30 is mounted to the crankcase 11, the cylinder block 12, and the cylinder head 13, and it extends frontward along the cylinder block 12 and the cylinder head 13. The air shroud 30 mainly covers right side portions of the crankcase 11, the cylinder block 12, and the cylinder head 13. In addition, the air shroud 30 partially covers upper and lower portions of the cylinder block 12 and the cylinder head 13.

The engine 10 according to the present preferred embodiment is preferably an air-cooled engine, the entire body of which is cooled by air. As illustrated in FIG. 2, a plurality of cooling fins 33 are provided on the cylinder block 12 and the cylinder head 13. However, the engine 10 may be an engine that includes the cooling fins 33 and also a portion of which is cooled by coolant. In other words, the engine 10 may be an engine a portion of which is cooled by air but another portion of which is cooled by coolant. The engine 10 may be a water-cooled type engine that does not include the fins 33.

As discussed previously, knocking occurs in a combustion chamber. When knocking occurs, the vibration associated therewith propagates from the combustion chamber to various parts of the engine 10. The crankcase 11 is located at a position more distant from the combustion chamber than the cylinder head 13 and the cylinder block 12. The vibration of knocking is believed to be transmitted sequentially to the cylinder head 13, the cylinder block 12, and the crankcase 11 in that order. In the engine 10 according to the present preferred embodiment, the boss 40 is provided on the crankcase 11, and the knock sensor 41 is mounted to the crankcase 11. For that reason, unless some consideration is made for the arrangement of the boss 40, the vibration is not transmitted to the knock sensor 41 sufficiently when knocking occurs, so the detection accuracy may be degraded.

The vibration of knocking propagates also through the bolt 60 from the cylinder head 13 or from the cylinder block 12 to the crankcase 11, not just from the cylinder block 12 to the crankcase 11. That is, the paths of the vibration of knocking include a path in which the vibration passes through the joint surface of the cylinder block 12 and the crankcase 11 (i.e., the surface in which the cylinder block 12 and the crankcase 11 are in contact with each other) and a path in which the vibration propagates from the cylinder block 12 and so forth through the bolt 60 to the crankcase 11. Note that in the present preferred embodiment, the gasket 51 is interposed between the cylinder block 12 and the crankcase 11. Accordingly, strictly speaking, the just-mentioned joint surface includes the surfaces of the cylinder block 12 and the crankcase 11 that are in contact with the gasket 51.

From the viewpoint of detecting the vibration passing through the joint surface of the cylinder block 12 and the crankcase 11, it is believed that the boss 40 should be located at a position near the combustion center. In other words, it is believed that the boss 40 should be positioned on the cylinder axis L1 when viewed in the axial direction of the boss 40. On the other hand, from the viewpoint of detecting the vibration passing through the bolt 60, it is preferable that the boss 40 be positioned near the bolt 60.

For these reasons, in the present preferred embodiment, the arrangement of the boss 40 is optimized so that the vibration of knocking that passes through the bolt 60 can be appropriately detected. Specifically, as illustrated in FIG. 4, the center 40*c* of the boss 40 is positioned toward the bolt 60 (that is, rightward) with respect to the cylinder axis L1, when viewed in the axial direction of the boss 40.

In the present preferred embodiment, the distance between the boss 40 and the bolt 60 is relatively short, i.e., shorter compared to when the boss 40 is positioned on the cylinder axis L1. As a result, the vibration of knocking that propagates through the bolt 60 easily reaches the boss 40. The knock sensor 41 can sufficiently detect the vibration of knocking that propagates through the bolt 60. According to the present preferred embodiment, although the knock sensor 41 is mounted to the crankcase 11, it is still possible to appropriately detect knocking.

As already described above, the crankcase 11 is located at a position more distant from the combustion chamber than the cylinder block 12. For this reason, the crankcase 11 has a lower temperature than the cylinder block 12. When the boss 40 is provided on the cylinder block 12, the temperature of the boss 40 tends to be higher. In that case, the knock sensor 41 is heated by the boss 40, and the temperature of the knock sensor 41 may become excessively high. As a consequence, the reliability of the knock sensor 41 may become lower. However, according to the present preferred embodiment, the boss 40 is provided on the crankcase 11. As a result, the temperature of the boss 40 can be kept low. Accordingly, the temperature increase of the knock sensor 41 can be suppressed and prevented, and the reliability of the knock sensor 41 can be enhanced.

As illustrated in FIG. 4, when viewed in the axial direction of the boss 40, the center 40*c* of the boss 40 may be positioned more to the right than the central line L3 of the bolt 60, but in the present preferred embodiment, the center 40*c* of the boss 40 is positioned between the cylinder axis L1 and the central line L3 of the bolt 60. The boss 40 is located at a position near the bolt 60 and at the same time is located at a position near the cylinder axis L1. According to the present preferred embodiment, the vibration of knocking that passes through the joint surface of the cylinder block 12 and the crankcase 11 and the vibration of knocking that passes through the bolt 60 are both transmitted to the boss 40. Both of the vibrations can be detected by the knock sensor 41.

As illustrated in FIG. 4, the front end 40*f* of the boss 40 is positioned frontward of the rear end 60*r* of the bolt 60, and the rear end 40*r* of the boss 40 is positioned rearward of the front end 60*f* of the bolt 60. The boss 40 and a portion of the bolt 60 are aligned, one on the right and the other on the left. With regard to the front-to-rear position, the boss 40 and a portion of the bolt 60 are located at an overlapping position. Therefore, the distance between the boss 40 and the bolt 60 can be made shorter, and the accuracy to detect knocking by the knock sensor 41 can be improved.

As illustrated in FIG. 4, when viewed in the axial direction of the boss 40, the right side portion 40R of the boss 40 overlaps with the peripheral portion 11*e* of the hole 11*h* of the crankcase 11. Therefore, the distance between the boss 40 and the bolt 60 can be made even shorter, and the accuracy to detect knocking by the knock sensor 41 can be improved further.

In the present preferred embodiment, the gasket 51 is preferably interposed between the crankcase 11 and the cylinder block 12. Therefore, the amount of the heat conducted from the cylinder block 12 to the crankcase 11 can be reduced, so the temperature increase of the crankcase 11 can be suppressed. Thus, the temperature increase of the boss 40 can be suppressed and prevented, and the knock sensor 41 can be prevented from being overheated by the boss 40. However, although the gasket 51 serves to suppress heat conduction, it may also damp vibrations. Nevertheless, the gasket 51 damps the vibration that passes through the joint surface of the crankcase 11 and the cylinder block 12 but it is less likely to damp the vibration that passes through the bolt 60. As discussed above, in the present preferred embodiment, the knock sensor 41 can detect the vibration that passes through the bolt 60. For this reason, it is possible to detect knocking despite the provision of the gasket 51. According to the present preferred embodiment, knocking can be detected while the temperature increase of the knock sensor 41 is suppressed and prevented.

While the motorcycle 1 is running, there are cases where stone chips, dirt, and the like are kicked up from the ground. If such kicked-up stone chips and the like collide against the knock sensor 41, the mounting condition of the knock sensor 41 may worsen and the detection accuracy may degrade. In addition, the knock sensor 41 may fail. However, in the present preferred embodiment, the boss 40 is provided on the top surface 11*a* of the crankcase 11. Therefore, the knock sensor 41 can be inhibited from being hit by the stone chips and the like that are kicked up from the ground.

By providing the boss 40 on the top surface 11*a* of the crankcase 11, the space above the crankcase 11 can be efficiently used as a space to install the knock sensor 41. In the present preferred embodiment, the intake pipe 35 or the throttle body 36 is disposed above the knock sensor 41, as illustrated in FIG. 3. The intake pipe 35 and the throttle body 36 are components that have greater strength than the knock sensor 41. Even if an object falls from above, the knock sensor 41 can be protected by the intake pipe 35 or the throttle body 36.

As illustrated in FIG. 3, the boss 40 is disposed frontward of the crankshaft 17. The vibration of knocking is transmitted to the boss 40 mostly from the front, but the rotational vibration of the crankshaft 17 is transmitted to the boss 40 from the rear. According to the present preferred embodiment, the vibration of knocking transmitted to the boss 40 is less likely to be affected by the rotational vibration of the crankshaft 17 than the case where the boss 40 is disposed rearward of the crankshaft 17. As a result, knocking can be detected more accurately by the knock sensor 41.

In the engine 10 according to the present preferred embodiment, airflow can be guided to the crankcase 11, the cylinder block 12, and the cylinder head 13 by the air shroud 30. The crankcase 11, the cylinder block 12, and the cylinder head 13 can be cooled effectively. The shape and dimensions of the air shroud 30 are not particularly limited. Airflow can be guided to the boss 40 by the air shroud 30, and the boss 40 can be cooled effectively by the air. The cooling capability of the boss 40 can be enhanced, and the temperature increase of the boss 40 can be suppressed and prevented. Thus, the temperature increase of the knock sensor 41 can be suppressed and prevented further.

Moreover, the air guided by the air shroud 30 can be supplied to the knock sensor 41, in addition to the boss 40. It is possible to cool the knock sensor 41 effectively by the air.

Figure 5:
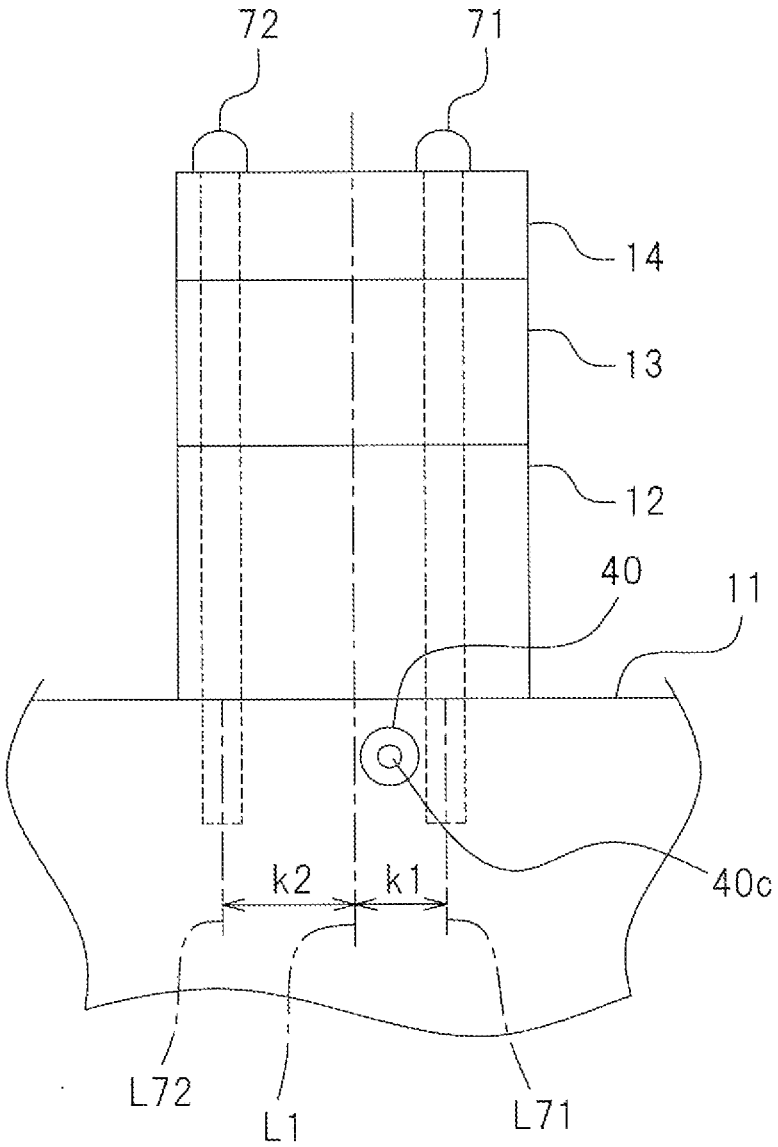
FIG. 5 is a schematic view illustrating a portion of an engine according to a modified example, viewed from an axial direction of the boss.

Although only one bolt 60 is depicted in FIG. 4, the engine 10 preferably includes a plurality of cylinder holding bolts, as described previously. There may be a case where the distance to the cylinder axis L1 varies from one of the bolts to another, when viewed in the axial direction of the boss 40. For example, as illustrated in the schematic view of FIG. 5, there is a case in which the distance k1 between the central line L71 of a bolt 71 and the cylinder axis L1 is shorter than the distance k2 between the central line L72 of another bolt 72 and the cylinder axis L1, when viewed in the axial direction of the boss 40. In such a case, it is possible to provide the boss 40 on the side of one of the bolts having a shorter distance to the cylinder axis L1, that is, on the side of the bolt 71. In other words, when viewed in the axial direction of the boss 40, the center 40*c* of the boss 40 may be positioned on the side of the bolt 71, which is the bolt that is closer to the cylinder axis L1. Thereby, knocking can be detected more appropriately.

Second Preferred Embodiment

In the engine 10 according to the first preferred embodiment, the boss 40 is provided on the crankcase 11. When the boss 40 is installed at a location other than a location on the cylinder block 12, the location to install the boss 40 is not limited to the crankcase 11.

Figure 6:
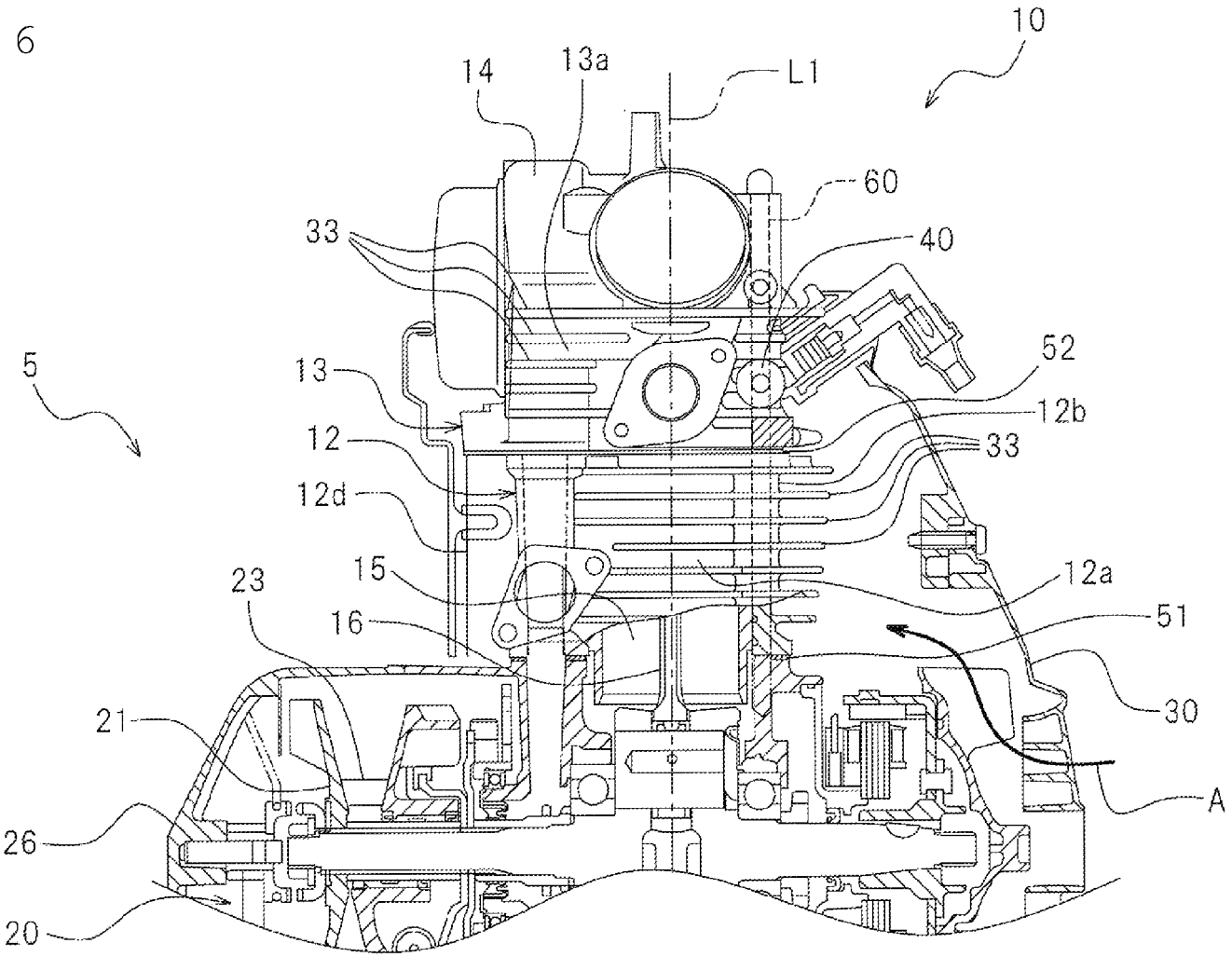
FIG. 6 is a view illustrating a portion of an engine according to a second preferred embodiment of the present invention, shown partly in section, viewed from an axial direction of the boss.

As illustrated in FIG. 6, in the engine 10 according to the second preferred embodiment, the boss 40 is provided on the cylinder head 13. The boss 40 is preferably provided on the top surface 13*a* of the cylinder head 13. In the present preferred embodiment as well, the boss 40 is positioned on the right side of the cylinder axis L1. When viewed in the axial direction of the boss 40, the center of the boss 40 is positioned on a side with respect to the cylinder axis L1 in which the bolt 60 is provided.

In the present preferred embodiment as well, the front end of the boss 40 is positioned frontward of the rear end of the bolt 60, and the rear end of the boss 40 is positioned rearward of the front end of the bolt 60. When viewed in the axial direction of the boss 40, a portion of the boss 40 is provided at a position overlapping the through-hole of the cylinder head 13. In other words, when viewed in the axial direction of the boss 40, a portion of the boss 40 is provided at a position overlapping the bolt 60. A gasket 52 made of a metallic material coated with a resin is preferably interposed between the cylinder head 13 and the cylinder block 12.

As already discussed above, the bolt 60 serves the role of transmitting the vibration of knocking. According to the present preferred embodiment, the vibration transmitted through the bolt 60 to the cylinder head 13 can be sufficiently detected by the knock sensor mounted to the boss 40.

Since the cylinder head 13 is closer to the combustion chamber than the crankcase 11, the vibration of knocking is transmitted more easily to the cylinder head 13 than to the crankcase 11. According to the present preferred embodiment, knocking can be detected with higher accuracy.

On the other hand, the gasket 52 is interposed between the cylinder head 13 and the cylinder block 12. The gasket 52 may damp the vibration that propagates from the cylinder block 12 to the cylinder head 13. Nevertheless, according to the present preferred embodiment, it is possible to detect not only the vibration transmitted directly from the cylinder block 12 to the cylinder head 13 but also the vibration transmitted through the bolt 60. Therefore, although the gasket 52 is interposed between the cylinder head 13 and the cylinder block 12, knocking can be detected.

Other Modified Preferred Embodiments

In the first preferred embodiment, the knock sensor 41 is provided directly on the boss 40. In other words, the knock sensor 41 and the boss 40 are in direct contact with each other. However, in order to prevent the knock sensor 41 from being heated by the boss 40, it is possible to interpose a heat insulation member between the boss 40 and the knock sensor 41.

It is preferable that the heat insulation member is made of a material having a lower thermal conductivity than the material of the boss 40. In addition, since the knock sensor 41 is a sensor that detects vibration, it is preferable that the heat insulation member be made of a material that does not easily damp vibration. In other words, it is preferable that the heat insulation member be made of a material that suppresses and prevents heat conduction but does not easily damp vibration. The material of the heat insulation member is not particularly limited, but, for example, it is desirable to use a material that has a thermal conductivity of about 1/10 or less (preferably 1/100 or less) and a density of about 1/10 or greater of that of the material of the boss 40.

The material of the boss 40, the material of the crankcase 11, and the material of the cylinder head 13 or the like on which the boss 40 is provided, is not particularly limited. Usable examples include ADC12 (DC material) having a thermal conductivity, as determined according to JIS R1611, of about 96 W/(m·K) and a density of about 2.68 kg/m$^3$, AC4B (LP) having a thermal conductivity of about 134 W/(m·K) and a density of about 2.77 kg/m$^3$, FC250 (cast iron) having a thermal conductivity of about 50 W/(m·K) and a density of about 7.3 kg/m$^3$, and alumina ceramic having a thermal conductivity of about 29 W/(m·K) and a density of about 3.9 kg/m$^3$. A suitable example of the heat insulation member is a phenolic resin. The thermal conductivity of the phenolic resin determined according to JIS A1412 is about 0.2 W/(m·K), which is less than about 1/100 of the thermal conductivities of the above-mentioned materials. In addition, the density of the phenolic resin is about 1.25 kg/m$^3$, which is greater than 1/10 of the densities of the above-mentioned materials.

The engine 10 in the foregoing preferred embodiments preferably is a horizontally mounted type engine in which the cylinder axis L1 extends in a horizontal direction or in a substantially horizontal direction. However, the direction of the cylinder axis L1 is not limited to the horizontal direction or the substantially horizontal direction. The engine 10 may be what is called a vertically mounted type engine, in which the cylinder axis L1 extends in a substantially vertical direction. For example, the inclination angle of the cylinder axis L1 from a horizontal plane may be about 45 degrees or greater, or about 60 degrees or greater.

The engine 10 is not limited to a unit swing type engine that swings relative to the body frame but may be an engine that is non-swingably fixed to the body frame.

In each of the foregoing preferred embodiments, the engine 10 includes the fan 28 that rotates with the crankshaft 17. In the foregoing preferred embodiments, air is forcibly supplied to the cylinder block 12 and so forth by the fan 28. However, the internal combustion engine according to the present invention may not necessarily include the fan 28. In a straddle-type vehicle such as the motorcycle 1, an airflow from the front to the rear is produced as the vehicle runs. The engine 10 may be an air-cooled engine that is configured to be cooled by such an airflow.

The engine 10 is not limited to an air-cooled engine. The internal combustion engine according to a preferred embodiment of the present invention may be a water-cooled engine. Alternatively, it may be an engine a portion of which is cooled by air but another portion of which is cooled by coolant. For example, fins may be provided on the cylinder block and at the same time a water jacket may be provided in the cylinder head so that the cylinder block can be cooled by air while the cylinder head can be cooled by coolant.

In each of the foregoing preferred embodiments, the engine 10 is preferably a four-stroke engine, for example. However, the internal combustion engine according to a preferred embodiment of the present invention may be a two-stroke engine, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A single-cylinder internal combustion engine for a vehicle, the single-cylinder internal combustion engine comprising:

a crankcase including one or more holes;

a cylinder block including one or more through-holes and including a cylinder provided therein, the cylinder including a cylinder axis;

a cylinder head including one or more through-holes and being mounted on top of the cylinder block;

a bolt inserted through one of the one or more holes of the crankcase, one of the one or more through-holes of the cylinder block, and one of the one or more through-holes of the cylinder head, to fix the crankcase, the cylinder block, and the cylinder head to each other;

a sensor mounting boss provided on the crankcase or the cylinder head; and a sensor arranged to detect knocking of the single-cylinder internal combustion engine; wherein the sensor is mounted to the sensor mounting boss;

when viewed in an axial direction of the sensor mounting boss, a center of the sensor mounting boss is positioned on a same side of the cylinder axis as the bolt; and when viewed in the axial direction of the sensor mounting boss, the center of the sensor mounting boss is positioned between the cylinder axis and a central line of the bolt.

2. The single-cylinder internal combustion engine according to claim 1, wherein:

the crankcase and the cylinder block are separate parts;

a gasket is interposed between the crankcase and the cylinder block; and the sensor mounting boss is provided on the crankcase.

3. The single-cylinder internal combustion engine according to claim 1, wherein:

the cylinder head and the cylinder block are separate parts;

a gasket is interposed between the cylinder head and the cylinder block; and the sensor mounting boss is provided on the cylinder head.

4. The single-cylinder internal combustion engine according to claim 1, wherein the sensor mounting boss is provided on a top surface of the crankcase.

5. The single-cylinder internal combustion engine according to claim 1, wherein:

a front end of the sensor mounting boss is positioned frontward of a rear end of the bolt; and a rear end of the sensor mounting boss is positioned rearward of a front end of the bolt.

6. The single-cylinder internal combustion engine according to claim 1, wherein:

the sensor mounting boss is provided on the crankcase; and when viewed in the axial direction of the sensor mounting boss, at least a portion of the sensor mounting boss overlaps with a peripheral portion of the one of the one or more holes of the crankcase.

7. The single-cylinder internal combustion engine according to claim 1, further comprising:

a crankshaft disposed in the crankcase; wherein the sensor mounting boss is disposed frontward of the crankshaft.

8. The single-cylinder internal combustion engine according to claim 1, wherein:

the bolt includes a first bolt positioned on one side of the cylinder axis when viewed in the axial direction of the sensor mounting boss, and a second bolt positioned on the other side of the cylinder axis; and when viewed in the axial direction of the sensor mounting boss, the center of the sensor mounting boss is positioned on the same side of the cylinder axis as the first bolt or the second bolt which is closer to the cylinder axis.

9. A straddle-type vehicle comprising:

a single-cylinder internal combustion engine according to claim 1.

10. A single-cylinder internal combustion engine for a vehicle, the single-cylinder internal combustion engine comprising:

a crankcase including one or more holes;

a cylinder block including one or more through-holes and including a cylinder provided therein, the cylinder including a cylinder axis;

a cylinder head including one or more through-holes and being mounted on top of the cylinder block;

a bolt inserted through one of the one or more holes of the crankcase, one of the one or more through-holes of the cylinder block, and one of the one or more through-holes of the cylinder head, to fix the crankcase, the cylinder block, and the cylinder head to each other;

a sensor mounting boss provided on the crankcase; and a sensor arranged to detect knocking of the single-cylinder internal combustion engine; wherein the sensor is mounted to the sensor mounting boss;

when viewed in an axial direction of the sensor mounting boss, a center of the sensor mounting boss is positioned on a same side of the cylinder axis as the bolt; and the sensor mounting boss is provided on a top surface of the crankcase.

11. The single-cylinder internal combustion engine according to claim 10, wherein the crankcase and the cylinder block are separate parts; and the single-cylinder internal combustion engine further comprises a gasket interposed between the crankcase and the cylinder block.

12. The single-cylinder internal combustion engine according to claim 10, wherein a front end of the sensor mounting boss is positioned frontward of a rear end of the bolt; and a rear end of the sensor mounting boss is positioned rearward of a front end of the bolt.

13. The single-cylinder internal combustion engine according to claim 10, wherein when viewed in the axial direction of the sensor mounting boss, at least a portion of the sensor mounting boss overlaps with a peripheral portion of the one of the one or more holes of the crankcase.

14. The single-cylinder internal combustion engine according to claim 10, further comprising:

a crankshaft disposed in the crankcase; wherein the sensor mounting boss is disposed frontward of the crankshaft.

15. The single-cylinder internal combustion engine according to claim 10, wherein:

the bolt includes a first bolt positioned on one side of the cylinder axis when viewed in the axial direction of the sensor mounting boss, and a second bolt positioned on the other side of the cylinder axis; and when viewed in the axial direction of the sensor mounting boss, the center of the sensor mounting boss is positioned on the same side of the cylinder axis as the first bolt or the second bolt which is closer to the cylinder axis.

16. A straddle-type vehicle comprising:

a single-cylinder internal combustion engine according to claim 10.

* * * * *